US005957700A

United States Patent [19]

Ariyama

[11] Patent Number: 5,957,700

[45] Date of Patent: Sep. 28, 1999

[54] WRITING BOARD

[75] Inventor: Kenzo Ariyama, Nagoya, Japan

[73] Assignees: Ricoh Elemex Corporation, Aichi-ken; Ricoh Company, Tokyo, both of Japan

[21] Appl. No.: 08/817,297

[22] PCT Filed: Aug. 17, 1995

[86] PCT No.: PCT/JP96/02300

§ 371 Date: Jun. 2, 1997

§ 102(e) Date: Jun. 2, 1997

[87] PCT Pub. No.: WO97/06963

PCT Pub. Date: Feb. 27, 1997

[30] Foreign Application Priority Data

Aug. 17, 1995 [JP] Japan ..... 7-231989

[51] Int. Cl.[6] ..... B43L 1/00

[52] U.S. Cl. ..... 434/417; 434/411

[58] Field of Search ..... 434/411, 417

[56] References Cited

U.S. PATENT DOCUMENTS

| | | | |
|---|---|---|---|
| 1,227,205 | 5/1917 | Sartakoff | 434/411 |
| 3,163,943 | 1/1965 | Bell | 434/417 |
| 3,858,265 | 1/1975 | Schlick | 434/417 X |
| 5,216,776 | 6/1993 | Dennison | 15/312.1 |
| 5,607,312 | 3/1997 | Zhou | 434/411 |
| 5,649,828 | 7/1997 | Kawashima | 434/411 |

FOREIGN PATENT DOCUMENTS

| | | |
|---|---|---|
| 700 613 | 12/1967 | Belgium . |
| 0 689 942 | 1/1996 | European Pat. Off. . |
| 1518669 | 3/1968 | France . |
| 2 083 414 | 3/1982 | United Kingdom . |

*Primary Examiner*—John A. Ricci
*Attorney, Agent, or Firm*—Venable; Norman N. Kunitz

[57] ABSTRACT

Writing boards such as electric blackboards which can erase all information written thereon without wiping the board by hand. On a front surface of an endless recording medium provided in the electric black board letters, characters, etc. are written with a writing tool. The writing tool uses an ink which is easily erasable with a cleaning liquid stored in a container. At the back surface of the recording medium, there is provided a cleaning instrument which faces the back surface of the recording medium. When all the writing is to be erased, an erasing switch is pushed. A pump is operated to move the recording medium, relative to the cleaning instrument. Thus, the cleaning liquid stored in the container circulates through tubes and the cleaning instrument and squeezes the cleaning liquid through an opening of the cleaning instrument to the recording medium.

11 Claims, 11 Drawing Sheets

WRITING BOARD

TECHNICAL FIELD

The present invention relates to writing boards such as the wall-hanging type, stand-supported type, and desktop type of blackboards, white boards, and green boards, in which writing is made on the surface of a recording medium using a writing tool such as a felt-tip marker.

BACKGROUND OF THE INVENTION

Conventionally, these types of writing boards have included boards, as illustrated in laid-open Japanese Patent Application KOKAI No. 7-90214, in which letters, characters and pictures are written on the writing board using a writing tool. When all the information produced by the writing tool is to be erased, the surface of the writing board is wiped with a wiping tool soaked with a cleaning liquid such as water, taking advantage of a chemical reaction for erasing the letters, etc.

However, these conventional writing boards have required all the information on the board to be erased by hand to wipe the board with the erasing tool.

An object of the present invention therefore is to provide a writing board in which all the information is written in ink, erasable with a cleaning liquid, on the surface of the recording medium of the board and is erased automatically with a cleaning liquid.

SUMMARY OF THE INVENTION

In a writing board of the present invention, like the electric board, wherein information is written on the surface of the recording medium using ink that is erasable with a cleaning liquid, an opening of a cleaning instrument is contacted against the surface of the recording medium, the cleaning instrument and/or surface of the recording medium can relatively be moved with respect to each other. On the other hand, a storage container holds a cleaning liquid. A pump is provided and circulates the cleaning liquid through the cleaning instrument and an erasing switch allows the pump to operate and the cleaning instrument and/or recording medium to make relative movement.

For erasing all the information written on the writing board, the erasing switch is turned ON to make the cleaning instrument or recording medium begin relative movement with respect to each other, while the pump is actuated to allow the cleaning liquid in the storage container to circulate through the cleaning instrument. The surface of the recording medium is then applied with the cleaning liquid through the opening of the cleaning instrument. After the written information has been erased, the recording medium and the cleaning instrument stop relative movement, and the pump stops its operation.

In the above-mentioned writing board, it is preferable to provide a valve such as a solenoid valve that shuts off the supply of the cleaning liquid into the cleaning instrument. After the written information has been erased, supply of the cleaning liquid into the cleaning instrument is thus shut off by closing the solenoid valve. The cleaning liquid is then sucked and removed from the cleaning instrument and the pump is stopped. This prevents leakage of the cleaning liquid from the opening of the cleaning instrument after the erasing has been performed.

According to the present invention, it is preferable that the cleaning instrument can freely be placed in contact with or kept apart from the recording medium. Namely, by switching the members and by operating the erasing switch, the cleaning instrument is squeezed against the recording medium when the written information is to be erased or otherwise kept apart from the recording medium. Thus the written information may be erased or not when desired.

According to the present invention, it is preferable that the contact surface of the cleaning instrument that comes into contact with the recording medium is coated with Teflon, a trademark for polytetrafluoroethylene. This prevents friction-caused damage to the surface of the recording medium and reduces frictional resistance between the recording medium and the cleaning instrument during their relative movement.

According to the present invention, the surface of the recording medium is preferably treated with sand mat by blasting sand on the surface thereof. The recording medium thus has increased surface roughness, writing information on the recording medium is facilitated and glare is reduced to provide visibility of the written information even from the side of the recording medium.

According to the present invention, a filter is preferably provided halfway in the passage of the circulating cleaning liquid, so that impurities can be removed from the cleaning liquid.

BRIEF DESCRIPTION OF THE DRAWINGS

FIG. 1 shows an electric blackboard of the wall-hanging type.

DESCRIPTION OF THE PREFERRED EMBODIMENTS OF THE INVENTION

The preferred embodiments of the present invention will hereinafter be described in detail with reference to the attached drawings.

Figure 1:
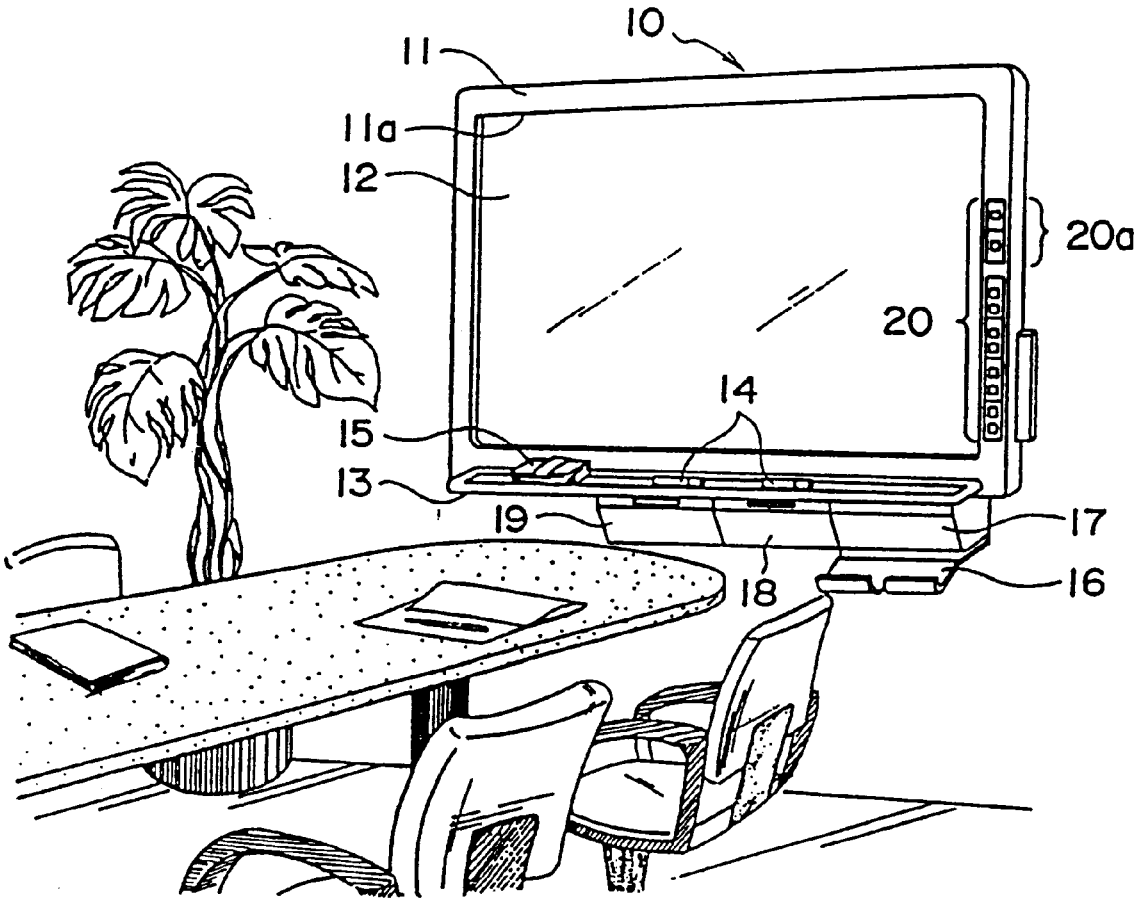
FIG. 1 is a view showing an embodiment of the writing board of the present invention. Specifically.

FIG. 1 shows a first embodiment of the writing board according to the present invention. The writing board illustrated is an electric blackboard 10, hung on the wall in a conference room.

A frame case 11 of the electric blackboard 10 is flat and rectangular in shape. The electric blackboard 10 is hung on the wall with the longer side at the top and with a large window-type opening 11*a* in front. A flat recording medium 12 for writing is fitted into the window-type opening 11*a*, and a part of the recording medium 12 is seen from the opening 11*a*, as will be described later. In the front of the frame case 11 is provided along and narrow tray 13 along the bottom edge of the frame case 11. The tray 13 holds writing tools 14 and a wiping tool 15.

The writing tools 14 are for writing letters, characters and pictures on the recording medium 12 and use ink which is erasable instantly by applying a liquid (cleaning liquid) such as water thereto, as described in Japanese Patent Application KOKAI No. 7-90214. The wiping tool 15 wipes the recording medium 12 to erase the information written with a writing tool 14, which holds a cleaning liquid that is capable of erasing the ink of the writing tool 14.

Below the frame case 11 is also provided a printer 17 having a paper receiver 16 in front and two storage cases 18 and 19 in that order. On one of the side edges of the frame case 11 is provided a group of switches 20. The switch group 20 includes a feed switch for moving the above-mentioned recording medium 12, a reading switch for reading the information written on the recording medium 12, and an erasing switch 20*a* for erasing the information written on the recording medium 12.

Figure 2:
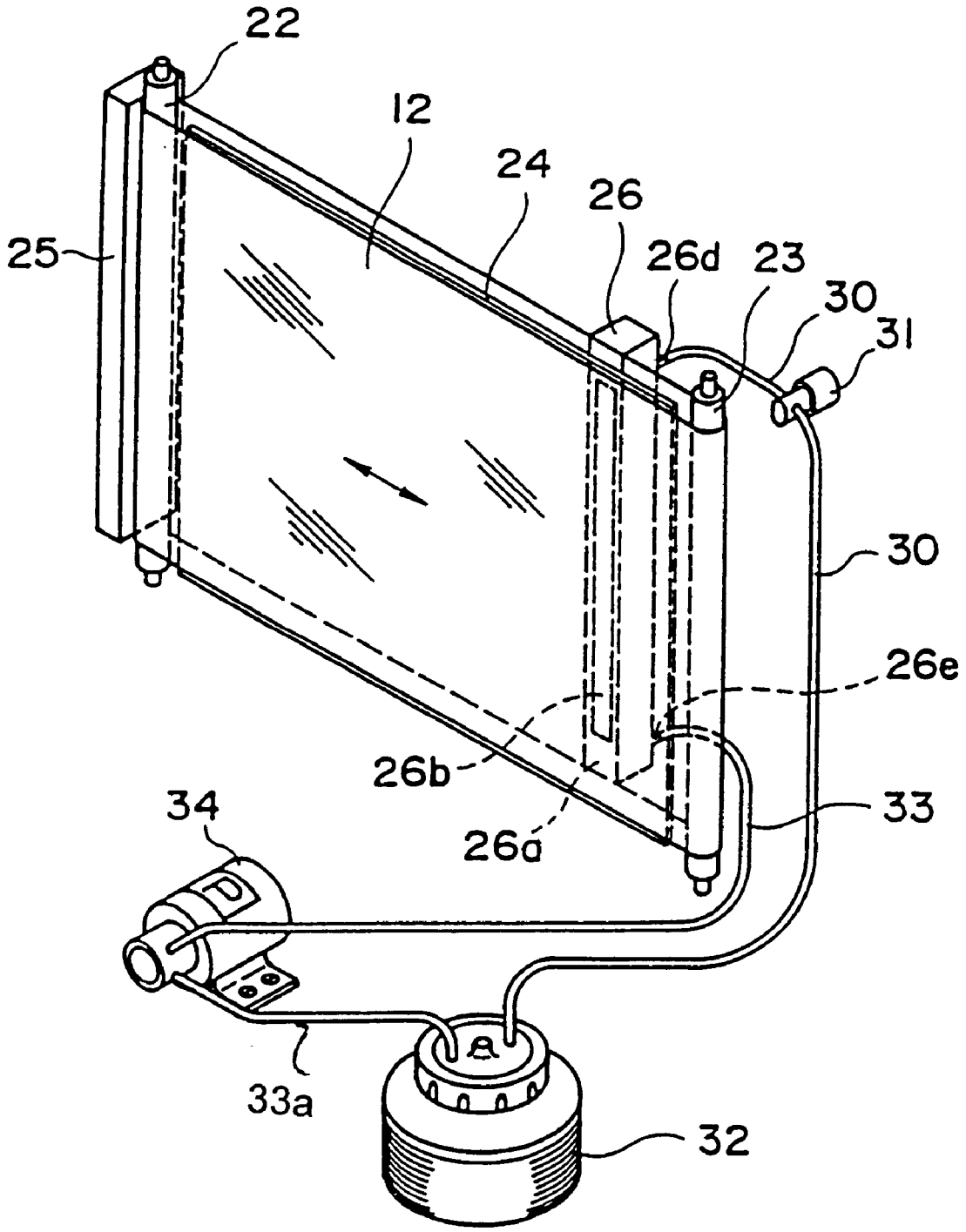
FIG. 2 is a perspective view of the general configuration of the internal mechanism of the electric blackboard of FIG. 1.

Inside the above-mentioned frame case 11 are provided a driving roller 22 on the left side and a driven roller 23 on the right side, both standing vertically and in parallel with each other, as shown in FIG. 2. Between these rollers 22 and 23 is passed an endless recording medium 12. A spring, not show, preloads the driven roller 23 with tension, thus keeping the recording medium tight between these rollers 22 and 23. By operating the feed switch of the switch group 20, rotation of the driving source, not shown, is transferred to make the driving roller 22 and the driven roller 23 rotate, thus moving the recording medium 12 in the left or right directions, as illustrated by the double-headed arrow of the figure. A plate 24 behind the recording medium 12 is a backing plate to line the portion appearing from the window-type opening 11*a*.

As shown in FIG. 2, inside the frame case 11 is provided a reading mechanism 25 on one side. The reading mechanism 25 is well known in the field of copying machines and writing boards of this type, and therefore a detailed explanation is not made here. The reading mechanism 25 reads the information written on the recording medium 12 while the recording medium 12 is being moved. The signals from the reading mechanism 25 are fed into the printer 17, the read information reduced in size is recorded on recording paper housed in the printer 17, and then the recording paper is discharged onto the paper receiver 16.

In the present invention, as shown in FIG. 2, a cleaning instrument 26 is pushed against the back surface of the tight endless recording medium 12. The cleaning instrument 26 is a square rod and has a face portion 26*a* that has a vertical opening 26*b*. As seen from the cross-sectional view shown in FIG. 3, the opening 26*b* has a concave groove 26*c*. Inside the concave groove 26*c* are mounted cleaning members in the terms of brushes 27, in two vertical lines. The leading ends of these brushes reach the face portion 26*a* of the cleaning instrument 26.

Figure 4:
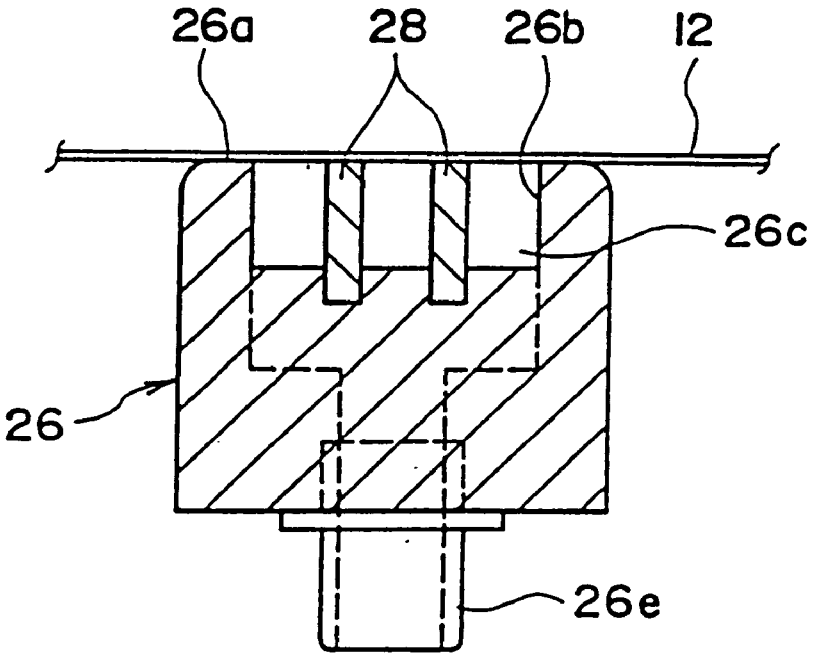
FIG. 4 is a cross-sectional view of another example of a cleaning instrument used for the electric blackboard.
Figure 5:
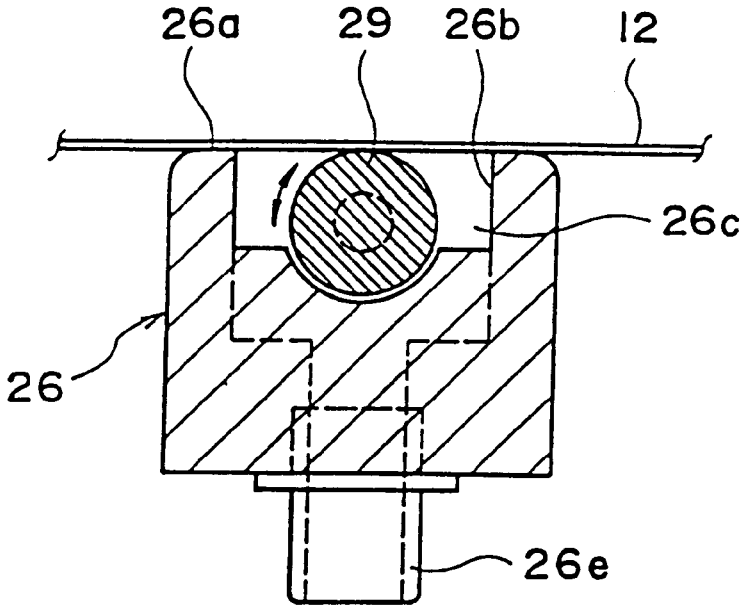
FIG. 5 is a cross-sectional view of a further example of a cleaning instrument used for the electric blackboard.

In the above-mentioned example, the concave groove 26*c* has two brushes in two vertical lines. These two brushes can be replaced with two partition plates 28 provided in two lines, as shown in FIG. 4. Or, they can be replaced with a rotatable roller 29, as shown in FIG. 5. In this case, the roller should preferably have a diameter whose outer surface almost reaches the face portion 26*a*.

This type of cleaning instrument 26, as shown in FIG. 2, has at the top an inductive port 26*d* that leads to the concave groove 26*c*. To the inductive port 26*d* is connected a tube 30. The tube 30 is connected through a solenoid valve 31 to a storage container 32. At the bottom, similarly, the cleaning instrument 26 has a discharge port 26*e* that leads to the concave groove 26*c*. To the discharge port 26*e* is connected another tube 33. The tube 33 is connected through a pump 34 to the storage container 32.

Figure 6:
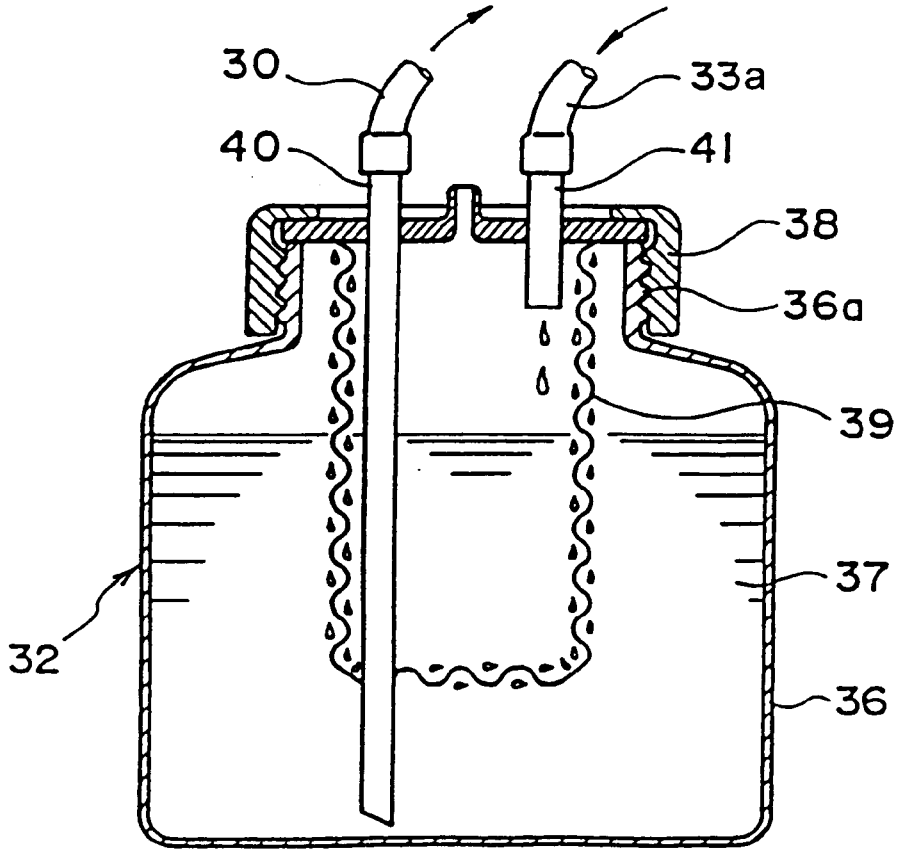
FIG. 6 is a vertical section of a storage container used for the electric blackboard.

The storage container 32, for example, is a bottle-shaped container 36 that contains a cleaning liquid 37, as shown in FIG. 6. A cap 38 is attached to a mouth 36*a* of the container 36. In the container a filter 39 is suspended from the cap 38. A discharge pipe 40 and inductive pipe 41 are passed through the cap 38. The tube 30 and the other tube 33 are connected to the discharge pipe 40 and the inductive pipe 41, respectively. The discharge pipe 40 reaches the bottom of the container 36 through the filter 39 while the inductive tube 41 reaches the same level as the mouth 36*a*.

These components form the following circulation route: the cleaning liquid circulates from the storage container 32 through the discharge pipe 40 into the tube 30. The cleaning liquid then flows through the solenoid valve 31 and leads to the inductive port 26*d* of the cleaning instrument 26. Through the concave groove 26*c* of the cleaning instrument, the cleaning liquid reaches the discharge port 26*e*. The cleaning liquid then passes through the other tube 33 , the pump 34, the tube 33*a* and the inductive pipe 41 back to the storage container 32. The pump 34 is operated to allow the cleaning liquid 37 to circulate through the above circulation route while filtrated by the filter 39.

In the embodiment shown in FIGS. 1–10, the storage container 32 shown in FIG. 2 is housed in the storage case 18 of FIG. 1, and the pump 34 shown in FIG. 2 in the storage case 19 of FIG. 1, respectively.

In this embodiment, it is preferable to provide a valve that shuts off the flow of the cleaning liquid 37 into the cleaning instrument 26, such as the solenoid valve 31. Needless to say, the valve is not necessarily limited to a solenoid valve as illustrated. For example, the solenoid valve can be replaced with a cam-operated mechanical valve that shuts off the cleaning liquid. In the present embodiment, it is preferable to provide a filter such as the filter 39 in the circulation route for the cleaning liquid. The filter is not necessarily installed inside the container 32, as illustrated, but can be installed at another location in the circulation route for the cleaning liquid. By installing the filter 39 in the circulation route, the filter 39 removes impurities from the cleaning liquid 37.

The embodiment of the electric blackboard shown in FIGS. 1–10 is used as described below. When the electric blackboard of the present invention is used, as in the case of the ordinary electric blackboard, a writing tool 14 on the tray 13 is held by hand. Letters, characters and pictures are written on the surface of the recording medium 12 while using the wiping tool 15, as required, for erasing. When more writing space is required on the recording medium within the window-type opening 11*a*, the feed switch is operated in the switch group 20. The recording medium 12 is then moved until a blank space having the desired area appears within the window-type opening 11*a*. Then writing may be continued in the blank space obtained.

When the information written on the blackboard is to be printed, the reading switch in the switch group 20 is pushed to read the material written on the recording medium 12. All the information written on the recording medium 12 is read by the reading mechanism 25. The information read is recorded on recording paper by the printer 17. The recording paper is then fed out onto the paper receiver 16.

Figure 3:
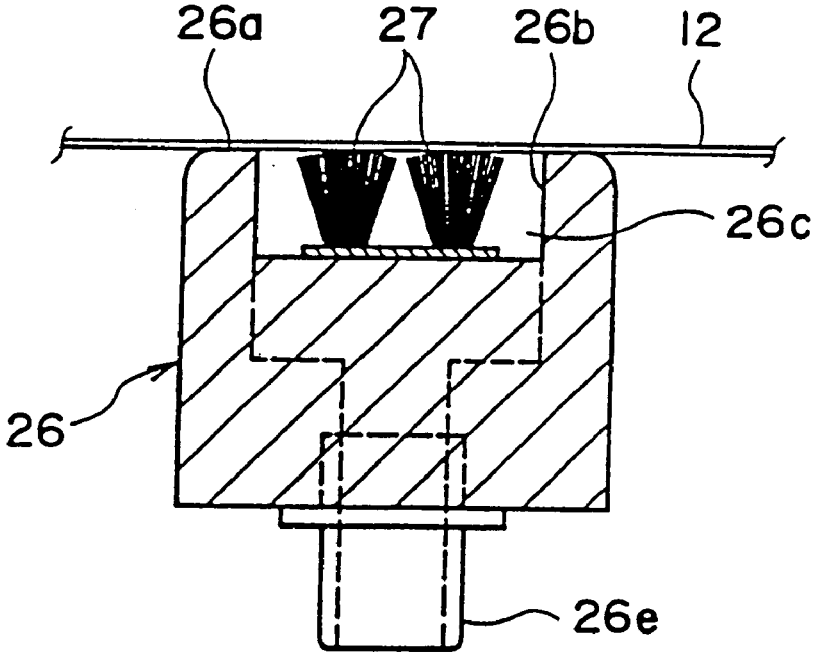
FIG. 3 is a cross-sectional view of a cleaning instrument used for cleaning the electric blackboard shown in FIG. 1.

When all the information written on the recording medium 12 is to be erased at one time, the erasing switch 20*a* is pushed in the switch group 20. The recording medium 12 moves and the pump 34 is actuated. A negative pressure is produced in the concave groove 26*c* of the cleaning instrument 26. The tension pulls the recording medium toward the cleaning instrument 26 for further tight contact between the recording medium 12 and the cleaning instrument 26. The recording medium 12 eventually comes into close contact with the contact face portion 26*a* of the cleaning instrument and its opening 26*b*. At this time, the leading tips of the brushes 27 come into contact with the surface of the recording medium 12, as shown in FIG. 3, to keep the recording medium 12 in shape and to keep the recording medium 12 out of the concave groove 26*c*. With the pump 34 operating, as shown by arrows in FIG. 7, the cleaning liquid 37 circulates from the storage container 32 through the concave groove 26*c* of the cleaning instrument 26 and flows back to the cleaning instrument, thus applying or coating the surface of the moving recording medium 12 with the cleaning liquid 37 that leaves the opening 26*c* of the cleaning instrument 26. In the example illustrated, the brushes 27 provided in the concave groove 26*c* help to evenly apply the surface of the recording medium 12 with the cleaning liquid 37 because the brushes can hold a sufficient amount of cleaning liquid 37.

Figure 8:
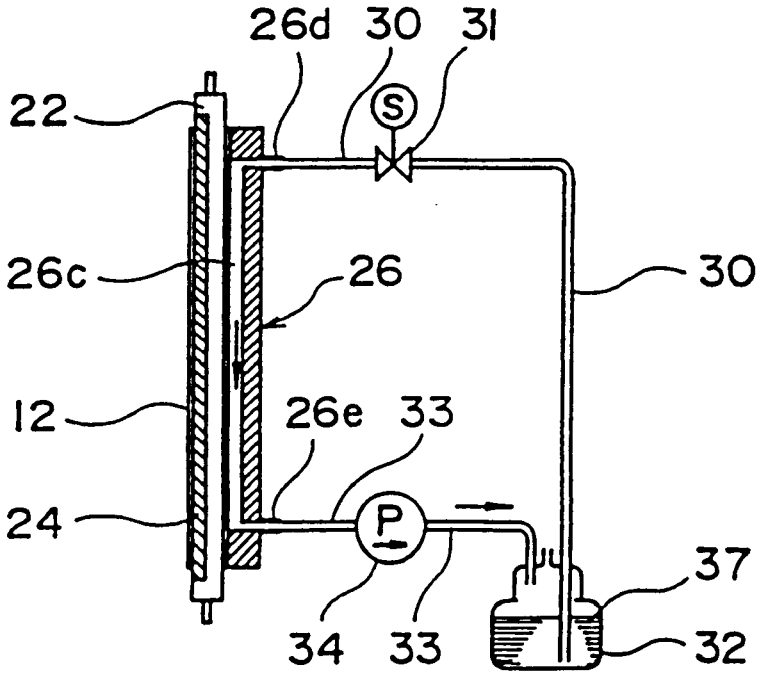
FIG. 8 is an explanatory drawing showing the flow of cleaning liquid in sucking and removing the remaining cleaning liquid after the written information has been erased.

After the written information has been erased, the erasing switch 20*a* is pushed to stop the moving of the recording medium 12 and the operation of the pump 34. In the embodiment shown, the solenoid valve 31 is closed by a timer for some period of time to shut off the cleaning liquid 37 that flows into the cleaning instrument 26 from the storage container 32, as shown in FIG. 8. The cleaning liquid 37 as well as ink sticking to the surface of the face portion 26*a* is then removed forcibly by suction from the cleaning instrument 26. When the cleaning liquid 37 has been completely removed from the face portion 26*a* after the lapse of the specified length of time, the pump 34 is stopped and the solenoid valve 31 is opened. This prevents leakage of the cleaning liquid 37 from the cleaning instrument 26 after erasing is performed.

When the solenoid valve 31 of, for example, a three-port valve is used and the remaining cleaning liquid is removed by suction, the passage from the storage container 32 to the cleaning instrument 26 is shut off, the opening of a passage to the atmosphere could all the more be effective for the incoming air in sucking the residual cleaning liquid.

Figure 7:
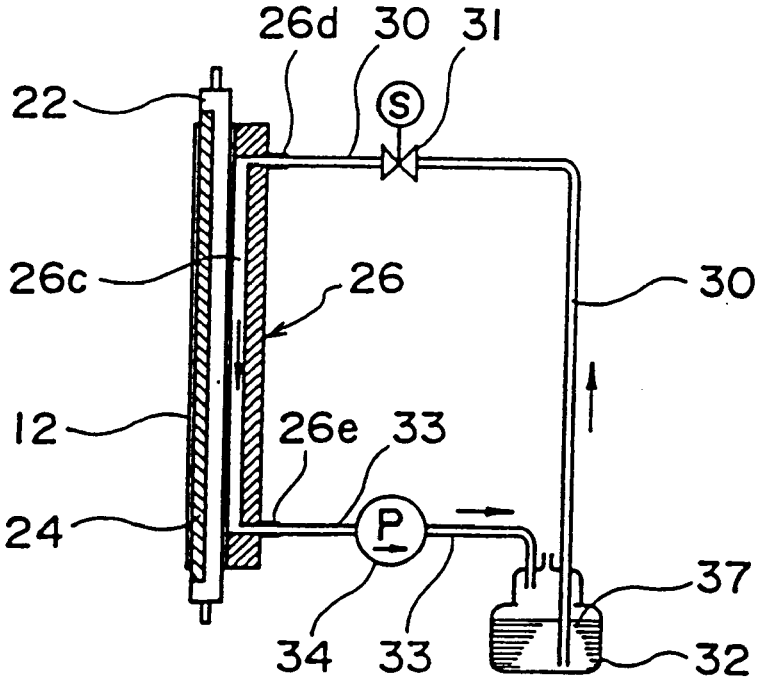
FIG. 7 is an explanatory drawing showing the flow of cleaning liquid in erasing written information on the electric blackboard.
Figure 9:
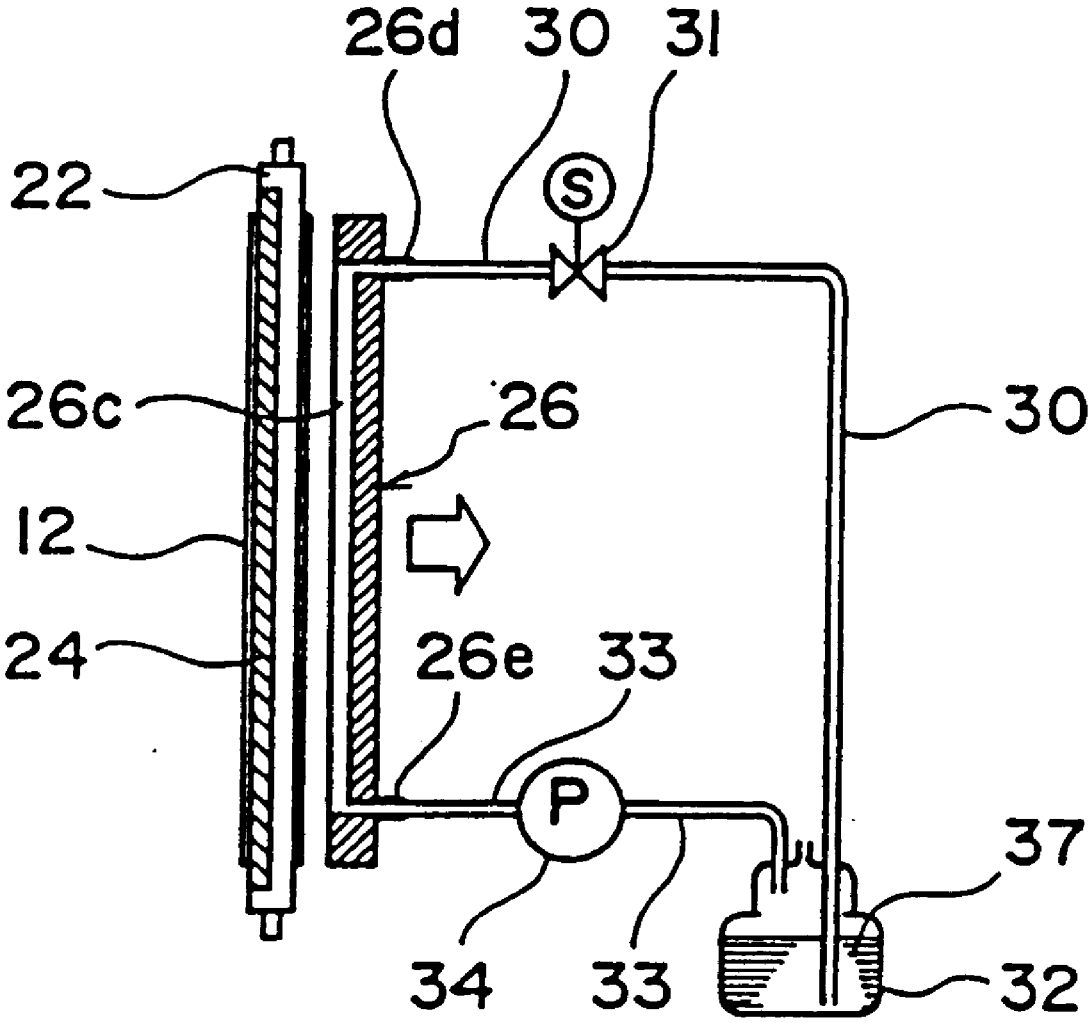
FIG. 9 is an explanatory drawing of the cleaning instrument kept apart from the recoding medium in the electric blackboard.

In the embodiment of FIGS. 1–10, by operating the switches and levers provided as required, or when the erasing switch 20*a* is operated, the cleaning instrument 26 may automatically be contacted with or be kept apart from the recording medium 12. In other words, when the written information is erased, the tension of the recording medium 12 brings it into contact with the cleaning instrument 26, as shown in FIG. 7. When the written information is not to be erased, operation of the solenoid valve, although not shown, allows a link mechanism to move the cleaning instrument 26, thus keeping the cleaning instrument 26 apart from the recording medium 12, as shown in FIG. 9.

In the illustrated embodiment, the contact face portion of the cleaning instrument 26 that comes into contact with the recording medium 12 is coated with Teflon, for example, by sticking Teflon tape thereon. This prevents friction-caused damage to the surface of the recording medium 12 and reduces frictional resistance between the recording medium 12 and the cleaning instrument 26.

Further, in the embodiment of FIGS. 1–10, the surface of the recording medium 12 is treated with sand mat by blasting sand on the surface. This increases the surface roughness in the recording medium 12, facilitates the writing of information on the recording medium 12, and provides glare-free visibility for the written information, for example, from the side of the recording medium 12.

Figure 10:
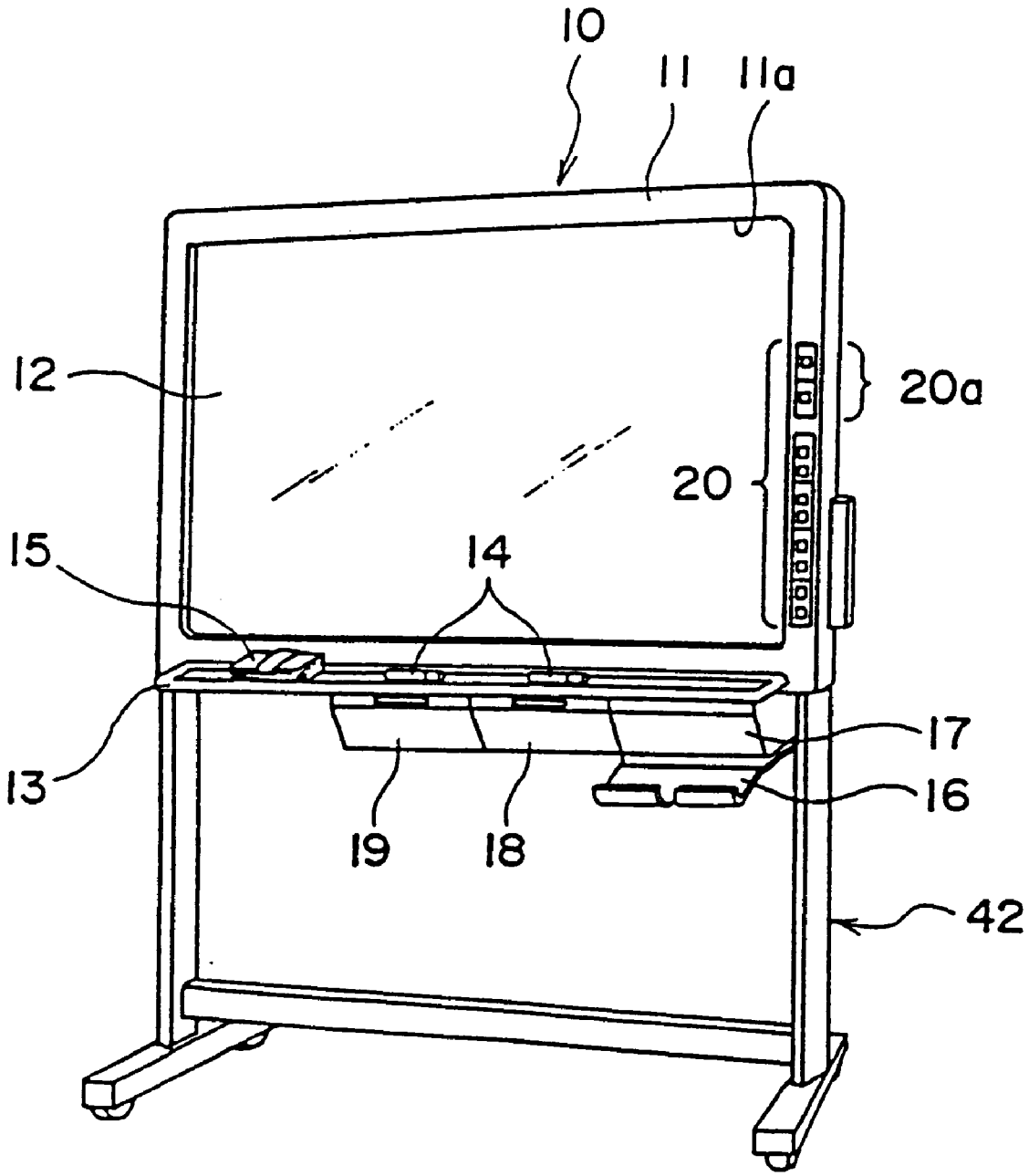
FIG. 10 is an explanatory drawing of the electric blackboard supported by a stand.

A wall-hanging type blackboard is shown in the above-described embodiment. According to the present invention, however, the writing board is not limited to the wall-hanging type, but can be of the stand-supported type in which the blackboard is supported by the stand, as shown in FIG. 10. Alternatively, it may be of the desk-top type (not shown), having a smaller size.

Figure 11:
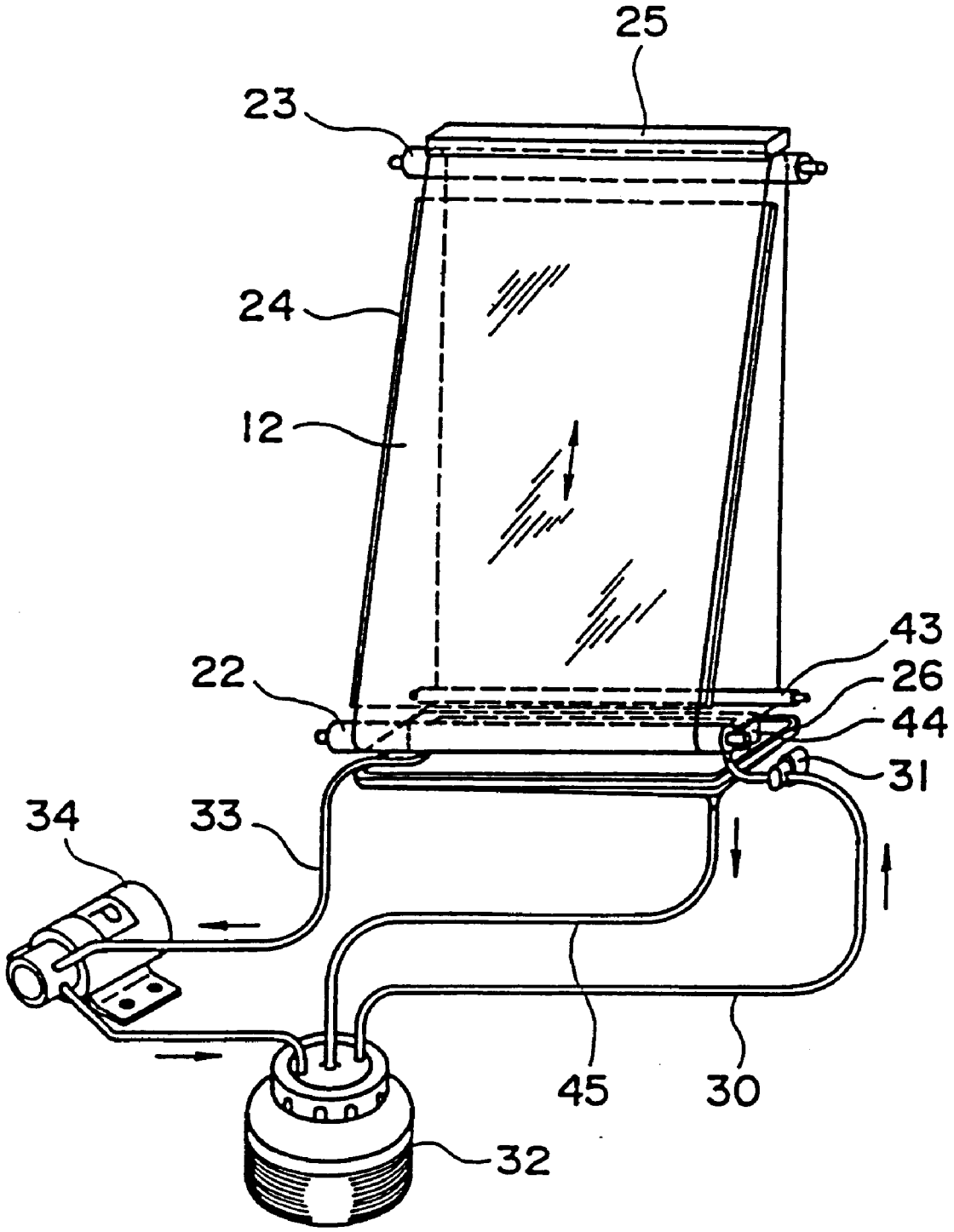
FIG. 11 shows another embodiment of the internal mechanism of the electric blackboard.

In the above-mentioned embodiments, the recording medium 12 is designed to move in the left or right directions, but the top to or top from bottom direction structure is also another choice, as shown in FIG. 11. That is to say, in FIG. 11, the driving roller 22 and the driven roller 23 are set in the horizontal position and a guide roller 43 is added. These rollers 22, 23, and 43 are set in such a way that the recording medium 12 is passed between and around the rollers 22, 23, 43 to form a triangle. The cleaning instrument 26 in this embodiment is contacted from below against the back of the part of the recording medium 12 that forms a base of the triangle between driving roller 22 and the guide roller 43. The cleaning instrument 26 is provided on a liquid receiving plate 44 and unexpected leakage of the cleaning liquid 37 from the cleaning instrument 26 drops into the liquid receiving plate 44. The cleaning liquid 37 in the plate 44 flows back to the storage container 32 through the tube 45. In FIG. 11, the same reference numerals are used to show parts corresponding to those of FIGS. 1–10 and therefore the detailed description will not be repeated.

In addition, in the embodiments above-mentioned, an endless type recording medium 12 has been shown which moves in a loop. According to the invention, however, a belt which is not endless can be alternative to the above type of recording medium 12. The ended belt type can be designed to be reciprocated tight between two and more rollers. A roll-up screen type recording medium can be another alternative. When this type is used, the recording medium is unfolded and hooked, being kept tight like a screen. After use, the recording medium is unhooked and automatically rolled up, for example. The cleaning instrument 26 is placed, for example, where the recording medium is pulled out, in such a way that the recording medium is placed between a back plate and the cleaning instrument 26. When rolled up after use, the recording medium is touched and applied with the cleaning liquid by the cleaning instrument and the written information is erased.

Figure 12:
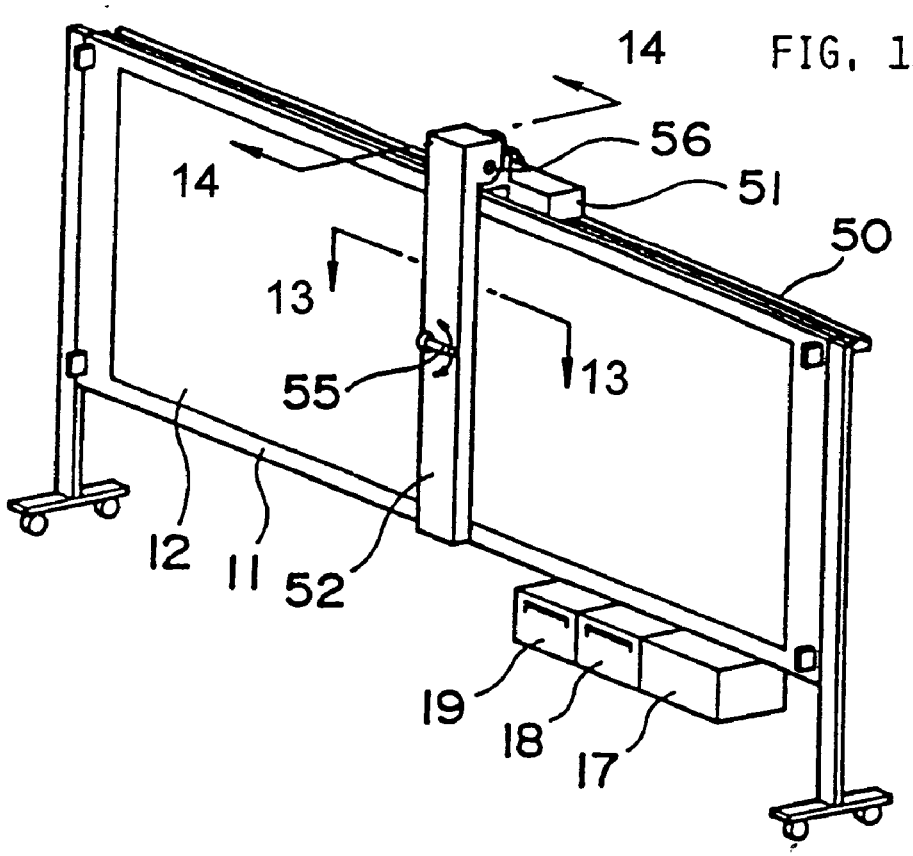
FIG. 12 is a perspective view of a further embodiment of the electric blackboard of the stand-supported type.

In addition, in the above-mentioned embodiments of the writing board of this invention the recording medium is moved with the cleaning instrument 26 fixed. However, the invention is not limited to the fixed type cleaning instrument. In short, the cleaning instrument can be relatively moved along the surface of the recording medium. As shown in FIG. 12, when the written information is erased, for example, the plate-like recording medium 12 can be fixed instead so that the cleaning instrument 26 can be moved along the recording medium 12. In the example of FIG. 12, the frame case 11 has a rail 50 on the top edge thereof. A slider 51 can move in a horizontal direction to right or left along the rail. The upper part of a traveling body 52 is attached to the slider 51.

Figure 13:
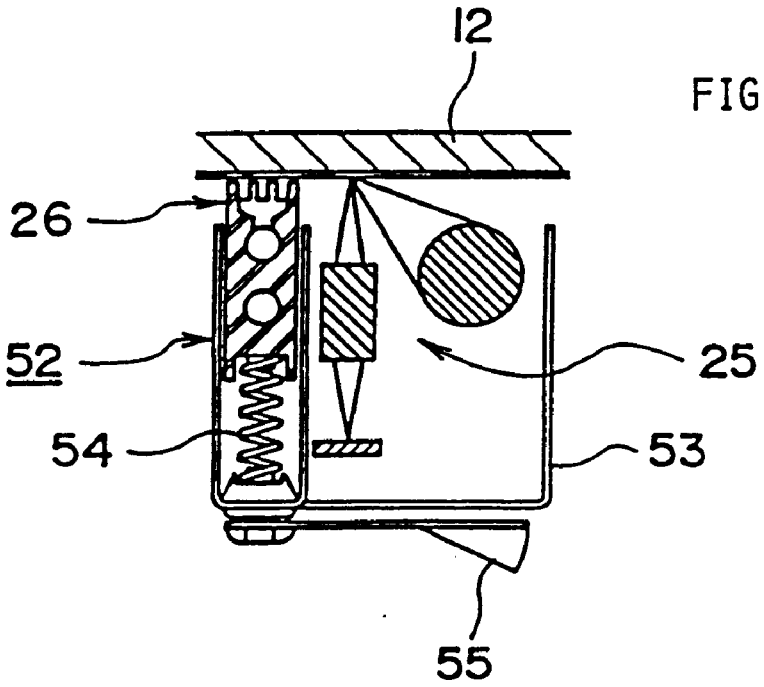
FIG. 13 is a partial cross-sectional view of the electric blackboard as viewed in the 13—13 direction in FIG. 12.

As seen from the cross-sectional view shown in FIG. 13, the traveling body 52 incorporates a combination of the reading mechanism 25 and the cleaning instrument 26 as a single unit in a case 53. The cleaning instrument is preloaded by a spring 54 and is made to contact against the plate-like recording medium 12. The case 53 has a lever-shaped switching member 55 on its outer surface. By turning the switching member 55, the spring 54 is allowed to contact the cleaning instrument 26 against the recording medium 12 when the written information is to be erased. When the written information is not to be erased, the recording medium 12 is moved against the force of the spring 54, thus keeping the cleaning instrument 26 apart from the recording medium 12.

Figure 14:
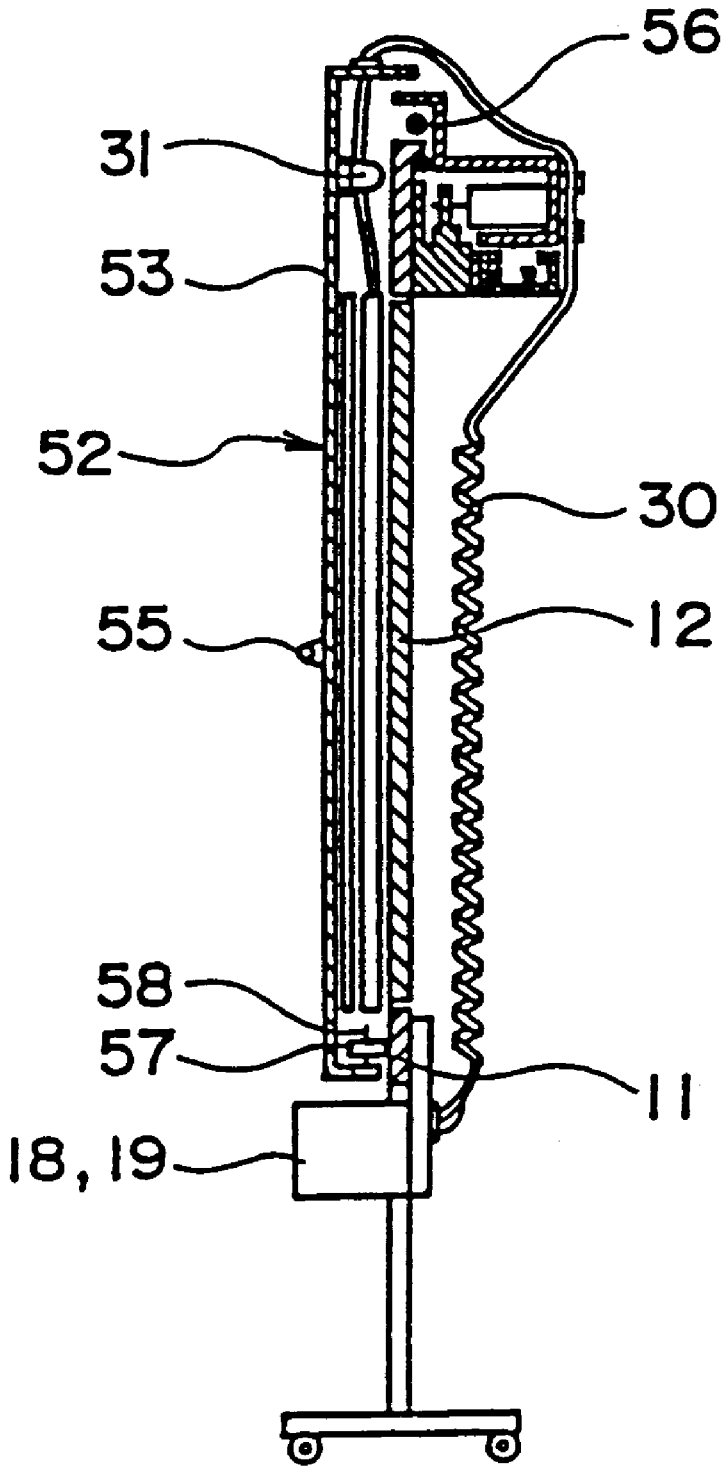
FIG. 14 is a vertical section of the electric blackboard as viewed in the 14—14 direction of FIG. 12.
Figure 15:
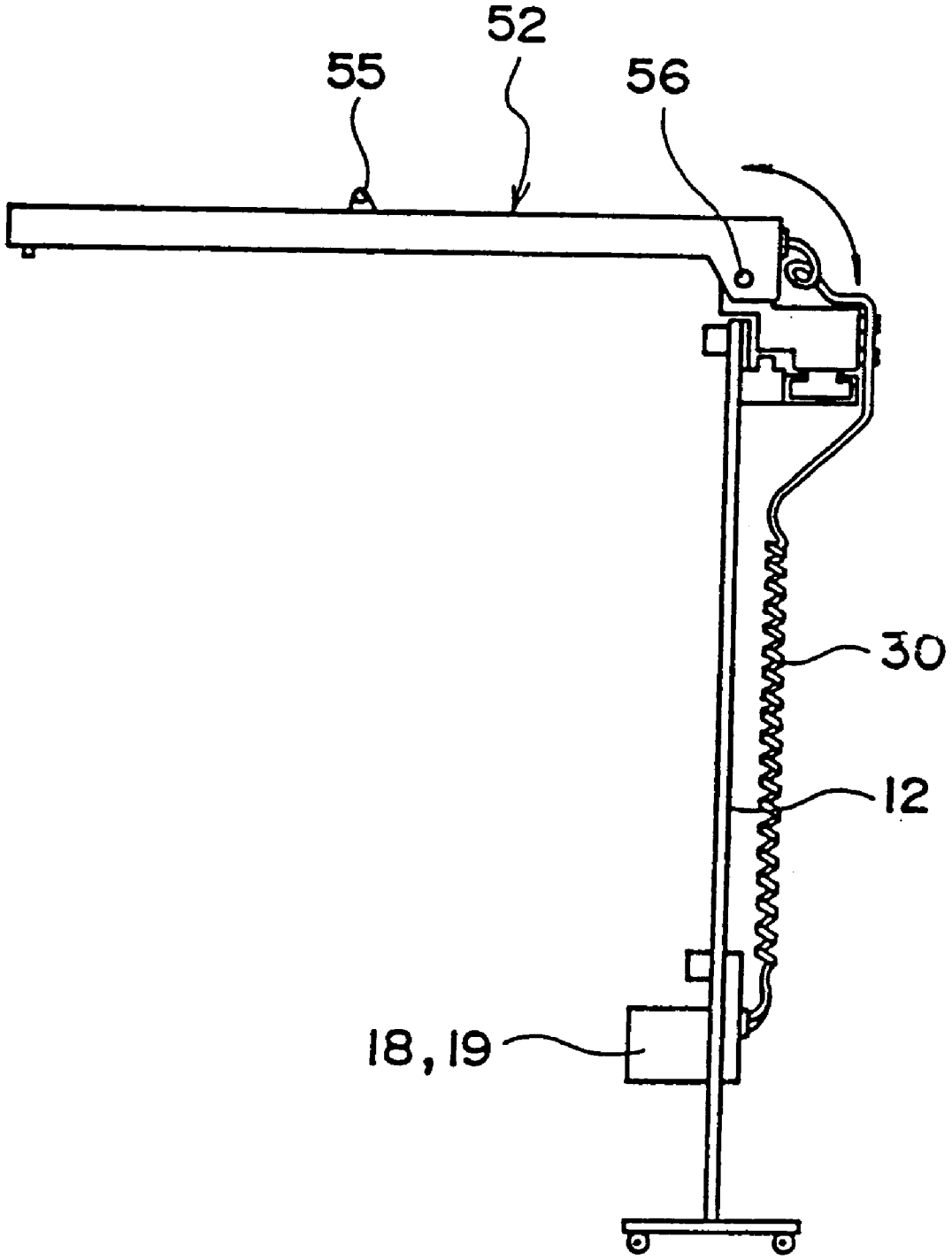
FIG. 15 is a side view of the electric blackboard with a traveling body in the rotated state.

The upper portion of the traveling body 52 is mounted to the slider 51 through an attaching shaft 56, and the outer periphery of a roller 57 provided at the bottom of the traveling body 52 is made to contact with the front bottom edge of the frame case 11, as shown in FIG. 14. The roller 57 is supported rotatably around a vertical shaft 58, at the bottom of the traveling body 52. In addition, the traveling body 52 is rotatable around the attaching shaft 56 and can be opened n a way shown in FIG. 15. In the embodiment shown in FIGS. 12 to 15, the same reference numerals for the same parts already described are used, and any detailed description is not made again. Availability in Industry As fully explained above, the present invention relates to writing boards such as the wall-hanging type, stand-supported type, and desktop type of blackboards, white boards, and green boards, in which writing is made on a recording medium on their surfaces by the use of writing tools such as felt-tip markers.

What is claimed is:

1. A writing board including a recording medium having a surface suitable for writing in ink thereon, comprising:

a cleaning instrument having a longitudinally extending groove therein mounted adjacent the recording medium, an inductive port located at a first end of said groove for introducing a cleaning liquid into said groove, and a discharge port at a second end of said groove opposite said first end for discharging said cleaning liquid from said groove, said cleaning instrument and the recording medium being movable with respect to each other;

at least one cleaning member mounted within the groove of said cleaning instrument adjacent the recording medium;

a storage container for holding said cleaning liquid;

a pump, said pump continuously circulating said cleaning liquid through a circulation path comprising said storage container, said inductive port, said longitudinally extending groove and said discharge port, the circulation of said cleaning liquid generating a negative pressure in said groove thereby bringing the recording medium into contact with said cleaning instrument and said cleaning member to clean ink from the recording medium.

2. A writing board as defined by claim 1 which further comprises a valve interposed in said circulation path, said valve being closed to remove excess cleaning liquid from said cleaning instrument by the negative pressure generated by operation of said pump.

3. A writing board as defined by claim 2 wherein said pump is interposed between said discharge port and said storage container, and said valve is interposed between said inductive port and said storage container.

4. A writing board as defined by claim 2 which further comprises a filter interposed in said circulation path.

5. A writing board as defined by claim 1 wherein a surface of said cleaning member which comes into contact with the recording medium is coated with polytetrafluoroethylene.

6. A writing board as defined by claim 1 therein the recording medium has a surface treated with sand mat.

7. A writing board as defined by claim 1 wherein said cleaning member comprises brushes.

8. A writing board as defined by claim 1 wherein said cleaning member comprises partition plates.

9. A writing board as defined by claim 1 wherein said cleaning member comprises a rotatable roller.

10. A writing board as defined by claim 1 wherein said recording medium has another surface opposite the surface suitable for the application of ink thereto, said cleaning instrument being positioned adjacent said another surface.

11. The method of cleaning ink from a surface of a recording medium of a writing board by means of a cleaning instrument, said cleaning instrument having a longitudinally extending groove therein located adjacent the surface of the recording medium, comprising the steps of moving at least one of said recording medium and said cleaning instrument with respect to each other; and continuously circulating a cleaning liquid through the longitudinally extending groove to generate a negative pressure within said groove thereby bringing the recording medium into contact with said cleaning instrument to clean ink from the recording medium.

* * * * *

UNITED STATES PATENT AND TRADEMARK OFFICE

CERTIFICATE OF CORRECTION

PATENT NO. : 5,957,700

DATED : September 28, 1999

INVENTOR(S) : Kenzo Ariyama, et al

It is certified that error appears in the above-identified patent and that said Letters Patent is hereby corrected as shown below:

On the title page, change item "[22] the date of PCT Filed" from "Aug. 17, 1995" to -- Aug 14, 1996 --.

Signed and Sealed this

Twenty-eighth Day of November, 2000

*Attest:*

*Attesting Officer*

Q. TODD DICKINSON

*Director of Patents and Trademarks*